US010051921B2

(12) United States Patent
Chun et al.

(10) Patent No.: US 10,051,921 B2
(45) Date of Patent: Aug. 21, 2018

(54) LIGHT-EMITTING SAFE BUCKLE

(71) Applicant: DONGGUAN CHANGMEI PLASTIC & HARDWARE CO., LTD, Dongguan (CN)

(72) Inventors: Feng Xiao Chun, Dongguan (CN); Zhu Xiao Rong, Dongguan (CN); He Wu Shi, Dongguan (CN)

(73) Assignee: Dongguan Changmei Plastic & Hardware Co., LTD, Dongguan (CN)

( * ) Notice: Subject to any disclaimer, the term of this patent is extended or adjusted under 35 U.S.C. 154(b) by 0 days.

(21) Appl. No.: 15/278,885

(22) Filed: Sep. 28, 2016

(65) Prior Publication Data

US 2017/0332741 A1 Nov. 23, 2017

(30) Foreign Application Priority Data

May 21, 2016 (CN) ..... 2016 1 0337393

(51) Int. Cl.
*A44B 11/25* (2006.01)
*F21S 9/02* (2006.01)
(Continued)

(52) U.S. Cl.
CPC ..... *A44B 11/2565* (2013.01); *A44B 11/2519* (2013.01); *A44B 11/266* (2013.01); *F21L 4/00* (2013.01); *F21S 9/02* (2013.01); *F21V 23/003* (2013.01); *F21V 23/0485* (2013.01); *F21V 31/005* (2013.01); *F21V 33/0004* (2013.01); *F21W 2121/06* (2013.01); *F21Y 2115/10* (2016.08)

(58) Field of Classification Search
CPC ..... A44B 11/2565; A44B 11/2519; A44B 11/266; F21S 9/02; F21V 23/003; F21V 23/0485; F21V 31/005; F21V 33/0004; F21V 33/00; F21V 99/00; F21Y 2115/10; F21W 2121/06; F21L 4/00
See application file for complete search history.

(56) References Cited

U.S. PATENT DOCUMENTS 5,181,773 A * 1/1993 Colvin ..... A44B 11/2565 280/801.1
9,016,241 B2 4/2015 Ding et al.
(Continued)

FOREIGN PATENT DOCUMENTS

| | | |
|---|---|---|
| CN | 103283983 | 9/2013 |
| CN | 205757612 | 12/2016 |
| KR | 20130035970 | 4/2013 |

OTHER PUBLICATIONS

European Search Report dated Oct. 4, 2017 in EP Application No. 17167091.2.

*Primary Examiner* — Bao Q Truong
(74) *Attorney, Agent, or Firm* — Dicke, Billig & Czaja, PLLC

(57) ABSTRACT

A light-emitting safe buckle is disclosed. The buckle includes, a light-emitting device, and a male buckle and a female buckle made of a transparent or translucent material, the light-emitting device being disposed on an intermediate setting portion of the male buckle. The male buckle and the female buckle are both made of a transparent or translucent material, such that light emitted by the light-emitting device can be quickly conducted and diffused to the whole structure.

18 Claims, 3 Drawing Sheets

(51) Int. Cl.

| | |
|---|---|
| ***F21V 23/00*** | (2015.01) |
| ***F21V 23/04*** | (2006.01) |
| ***F21V 31/00*** | (2006.01) |
| ***F21V 33/00*** | (2006.01) |
| ***A44B 11/26*** | (2006.01) |
| ***F21L 4/00*** | (2006.01) |
| *F21Y 115/10* | (2016.01) |
| *F21W 121/06* | (2006.01) |

(56) References Cited

U.S. PATENT DOCUMENTS

| | | | | |
|---|---|---|---|---|
| 9,320,262 | B2 | 4/2016 | Wang et al. | |
| 2004/0051474 | A1* | 3/2004 | Wong | A41D 27/085 315/291 |
| 2008/0122133 | A1 | 5/2008 | Zheng | |
| 2010/0003393 | A1 | 1/2010 | Torney et al. | |
| 2012/0089302 | A1* | 4/2012 | Griffin | B60R 21/00 701/45 |
| 2014/0239853 | A1* | 8/2014 | Woodham | F21V 33/0064 315/362 |
| 2016/0059778 | A1* | 3/2016 | Ghannam | B60R 22/00 297/217.6 |

* cited by examiner

LIGHT-EMITTING SAFE BUCKLE

CROSS REFERENCE TO RELATED APPLICATION

This Utility Patent Application claims priority to Chinese Patent Application No. 201610337393.4, filed May 21, 2016; and which is incorporated herein by reference.

TECHNICAL FIELD

The present invention relates to the technical field of buckles, and in particular, to a light-emitting safe buckle.

BACKGROUND ART

In modern society, people need to use various buckles in life, for example, buckles applied to articles such as suspenders, packing belts, bags and suitcases, and pet chain ropes, thereby implementing operations of quick binding and unlocking. To meet the requirements of people, there are diversified buckles available in the market, each having a different design idea, thereby striving to achieve use requirements of different users.

However, existing buckles are simple in structure design, have single functions, and cannot emit light. When a user uses a buckle outdoor or in a dark environment, the position where the user locates cannot be precisely shown, no warning or attention-attracting function can be achieved, and therefore, accidents may be easily caused. The Chinese Invention Patent with the Authorization Publication No. of CN 204305821U and entitled "Safe Pet Buckle" discloses a safe pet buckle, which includes a male buckle and a female buckle fitting in the male buckle in an inserted manner, an assembly concave cavity is formed in an upper surface of the female buckle, and is provided with a reflection piece or a luminous piece. The buckle can achieve a reflection or luminous effect; however, it can be reflective or luminous only in the presence of a light source, the reflection or luminous distance and the luminous time are short, and a reflection or luminous position is small, such that the buckle still does not have the warning effect at night, and there are hidden dangers, bringing about inconvenience to people's life.

SUMMARY OF THE INVENTION

In view of the above defects, an objective of the present invention provides a light-emitting safe buckle which has an ingeniously and reasonably designed structure, a light-emitting function and a good light-emitting effect, and is safe and reliable.

The present invention is further illustrated with reference to accompanying drawings and embodiments.

DETAILED DESCRIPTION

Figure 1:
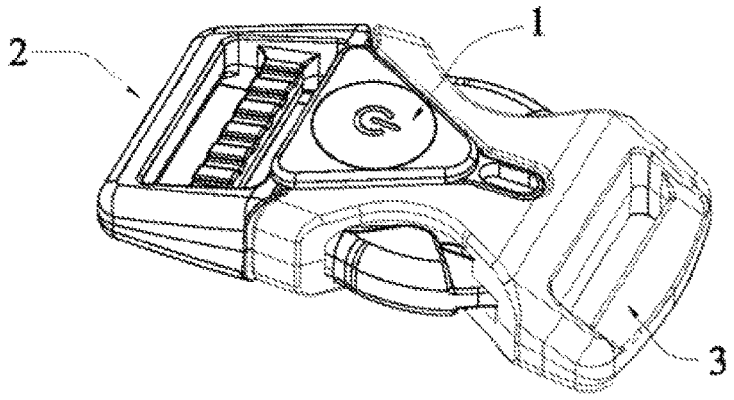
FIG. 1 is a schematic three-dimensional structural diagram of the present invention.
Figure 2:
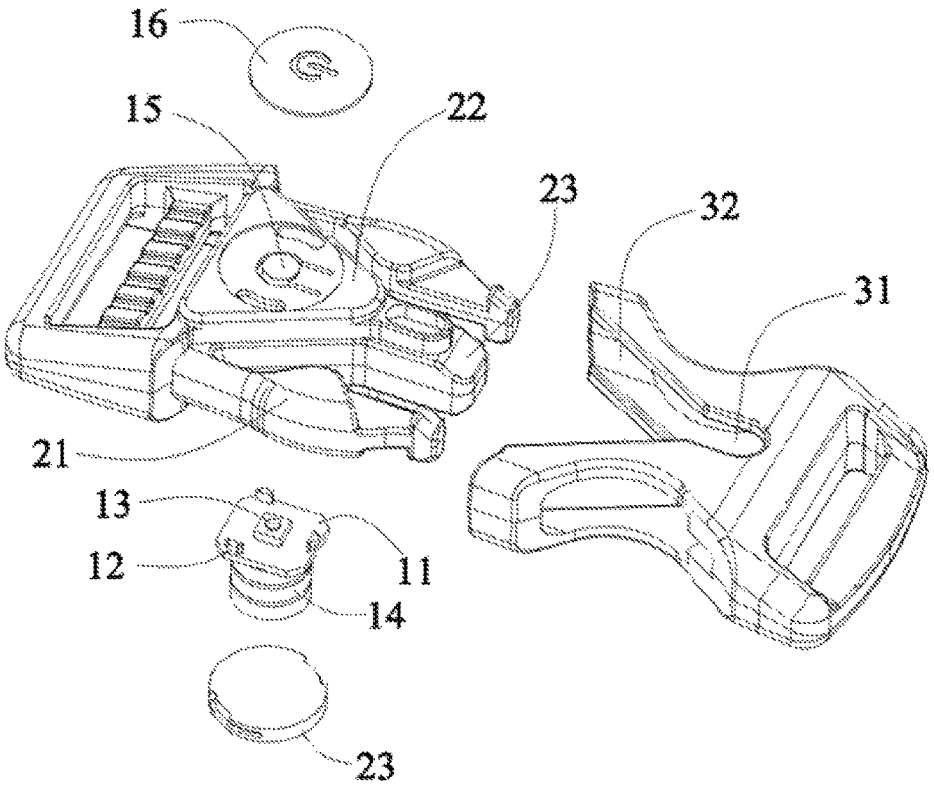
FIG. 2 is a schematic exploded structural diagram of FIG. 1.
Figure 3:
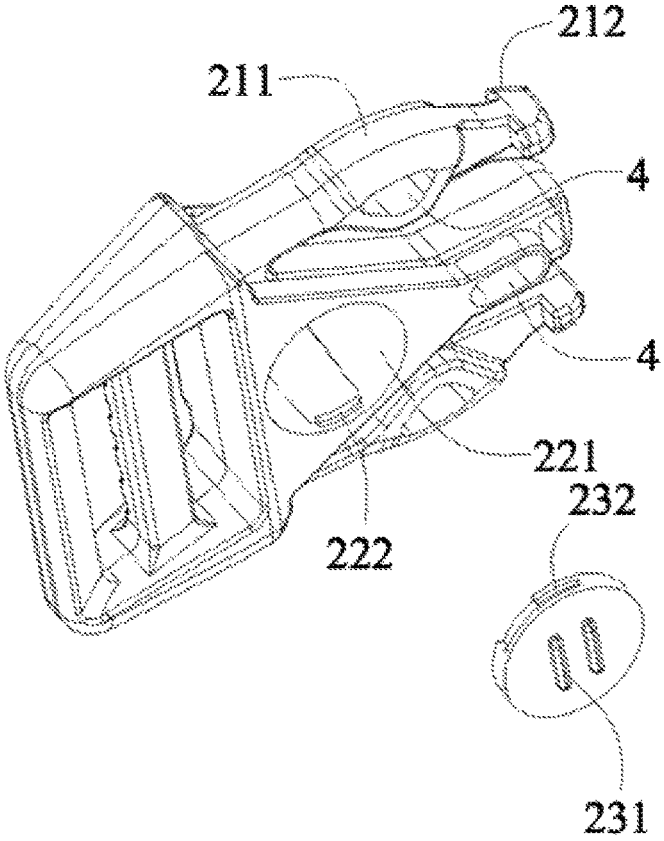
FIG. 3 is a schematic structural diagram of the male buckle in FIG. 1.
Figure 4:
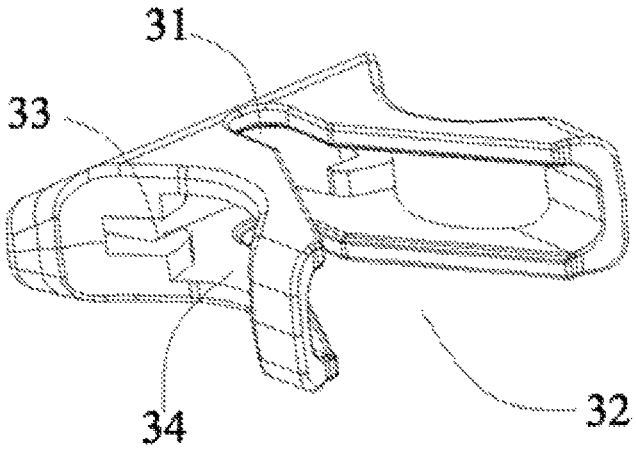
FIG. 4 is a schematic structural diagram of the female buckle in FIG. 1.

The present invention provides a light-emitting safe buckle, including a light-emitting device, and a male buckle and a female buckle made of a transparent or translucent material, an intermediate setting portion being disposed between two elastic pins of the male buckle, one end position of the intermediate setting portion facing the female buckle being projected to form a guide rod, a guide slot adapted to the guide rod being disposed on the female buckle, the intermediate setting portion being provided with an accommodation cavity for disposing the light-emitting device, and the light-emitting device being disposed in the accommodation cavity.

As an improvement of the present invention, the contour of the intermediate setting portion is triangle-shaped, and the guide rod is located at a corner portion position of the intermediate setting portion facing the female buckle.

As an improvement of the present invention, the female buckle is provided with a triangular notch adapted to the intermediate setting portion.

As an improvement of the present invention, the light-emitting device includes a control circuit board, LED lamps, a touch switch and a battery, the touch switch is disposed in a center position of the control circuit board, the plurality of LED lamps is symmetrically disposed at peripheral positions of the control circuit board with the touch switch as the center of a circle and faces an inner wall of the accommodation cavity, and the battery is disposed at a lower position of the control circuit board and is connected to the control circuit board.

As an improvement of the present invention, there are three LED lamps which are disposed at the peripheral positions of the control circuit board symmetrically about the center of a circle, and correspondingly face three corner portions of the intermediate setting portion.

As an improvement of the present invention, a position on an upper surface of the male buckle corresponding to the accommodation cavity is provided with an elastic presser foot that can trigger the touch switch when being pressed downwards, and a waterproof sealed cap for covering the elastic presser foot is disposed on the male buckle.

As an improvement of the present invention, an opening of the accommodation cavity is located on a lower surface of the male buckle, a round screw-cap capable of closing the opening is disposed on the male buckle, a lower surface of the round screw-cap is provided with a rib convenient for turning the round screw-cap, an outer side surface of the round screw-cap is provided with a rotation position groove, and the inner wall of the accommodation cavity is provided with a rotation position repousse adapted to the rotation position groove.

As an improvement of the present invention, an opening of the accommodation cavity is located at a lower surface of the male buckle, and a triangular cap capable of closing the opening is fixed on the male buckle with a screw.

As an improvement of the present invention, a middle portion of the elastic pin is projected outwards in an arced mode to form a pressing portion, a tail end thereof extends into an insertion cavity of the female buckle and is projected on upper and lower surfaces to form a hook portion, and a hook position adapted to the hook portion is disposed in the insertion cavity.

As an improvement of the present invention, an outer surface of the pressing portion is provided with a material-saving recess, and an outer surface of the guide rod is provided with a material-saving recess.

The present invention has the following beneficial effects: the present invention is ingenious in structural design, designs the structure of the male buckle scientifically and reasonably, and makes full use of the space ingeniously to dispose the light-emitting device on the male buckle, thus having a beautiful appearance without any abrupt feeling. Moreover, the male buckle and the female buckle are both made of a transparent or translucent material, light emitted by the light-emitting device can be quickly conducted and diffused to the whole structure, the light-emitting area is large, the light-emitting effect is good, and it can provide a striking vision warning function when being used by a user outdoor or in a dark environment, can precisely show the position of the user, effectively avoids occurrence of accidents and is safe. Moreover, the LED lamps may be in many colors, thus having more warning effects. In addition, the present invention is impact in overall structure, tight in connection, high in reliability, small in volume, and easy to implement, thereby being conducive to wide popularization, and being applicable to articles such as clothes, packing belts, hiking backpacks, and pet chain ropes.

Referring to FIG. 1 to FIG. 4, a light-emitting safe buckle provided in this embodiment includes a light-emitting device 1, a male buckle 2 and a female buckle 3. The male buckle 2 and the female buckle 3 are made of a transparent or translucent material, such as PC, PP, and PVC. An intermediate setting portion 22 is disposed between two elastic pins 21 of the male buckle 2, one end position of the intermediate setting portion 22 facing the female buckle 3 is projected to form a guide rod 23, a guide slot 31 adapted to the guide rod 23 is disposed on the female buckle 3, the intermediate setting portion 22 is provided with an accommodation cavity 221 for disposing the light-emitting device 1, and the light-emitting device 1 is disposed in the accommodation cavity 221. The structure is ingeniously designed, the structure of the male buckle 2 is scientifically and reasonably designed, and the light-emitting device 1 is disposed on the male buckle 2 by making full use of the space ingeniously, and thus the appearance is beautiful without any abrupt feeling. The conventional reflection piece is disposed on the female buckle, which projects outwards apparently, has a poor overall harmony, and has an abrupt feeling, thus being poor in appearance.

Specifically, the light-emitting device 1 includes a control circuit board 11, LED lamps 12, a touch switch 13 and a battery 14. The touch switch 13 is disposed in a center position of the control circuit board 11, the plurality of LED lamps 12 is symmetrically disposed at peripheral positions of the control circuit board 11 with the touch switch 13 as the center of a circle and faces the inner wall of the accommodation cavity 221, and the battery 14 is disposed at a lower position of the control circuit board 11 and is connected to the control circuit board 11.

Preferably, the contour of the intermediate setting portion 22 is triangle-shaped, and the female buckle 3 is provided with a triangular notch 32 adapted to the intermediate setting portion 22. The guide rod 23 is located at a corner portion position of the intermediate setting portion 22 facing the female buckle 3. Preferably, there are three LED lamps 12 which are disposed at the peripheral positions of the control circuit board 11 symmetrically about the center of a circle, and correspondingly face three corner portions of the intermediate setting portion 22. As the contour of the intermediate setting portion 22 is triangle-shaped, light of the LED lamps 12 can be refracted multiple times by the corner portions of the intermediate setting portion 22 to further form a diffusion effect, thus better diffused to the overall structure of the male buckle 2 and the female buckle 3, to avoid that a linear light source irradiated vertically dazzles human eyes; in contrast, refracted light is soft and more adaptive to human visual feelings, thereby greatly improving the reflection effect. The LED lamps may be in one or more colors to have more warning effects.

A position on an upper surface of the male buckle 2 corresponding to the accommodation cavity 221 is provided with an elastic presser foot 15 that can trigger the touch switch 13 when being pressed downwards; preferably, the elastic presser foot 15 is integrated with the male buckle 2; and a waterproof sealed cap 16 for covering the elastic presser foot 15 is disposed on the male buckle 2, which has a good sealing effect, is waterproof and dustproof, and effectively prolongs the service life.

Figure 5:
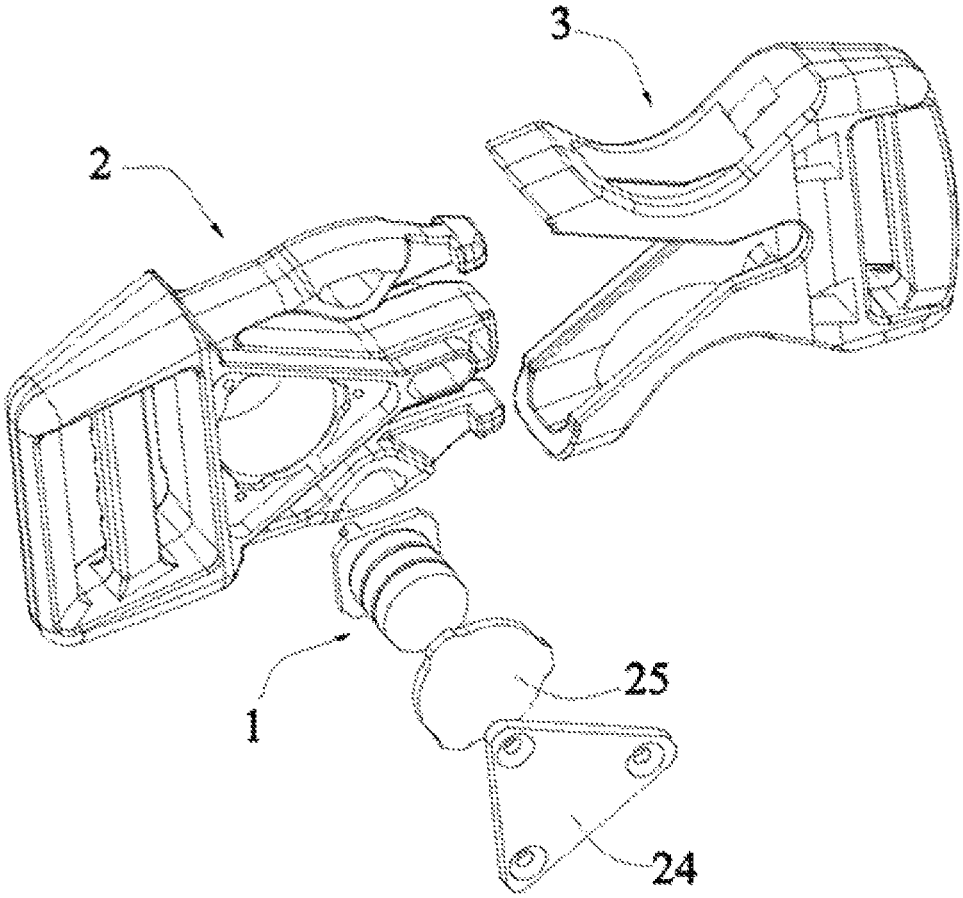
FIG. 5 is a schematic structural diagram of another embodiment of the present invention.

In this embodiment, an opening of the accommodation cavity 221 is located on a lower surface of the male buckle 2, a round screw-cap 23 capable of closing the opening is disposed on the male buckle 2, a lower surface of the round screw-cap 23 is provided with a rib 231 convenient for turning the round screw-cap, an outer side surface of the round screw-cap 23 is provided with a rotation position groove 232, the inner wall of the accommodation cavity 221 is provided with a rotation position repousse 222 adapted to the rotation position groove 232, and therefore, the round screw-cap 23 can be opened manually without using a specific tool such as a screwdriver, thereby being convenient for replacement of the battery 14. In another embodiment, referring to FIG. 5, the opening of the accommodation cavity 221 is located at a lower surface of the male buckle 2, and a triangular cap 24 capable of closing the opening is fixed on the male buckle 2 with a screw, which can also close the opening of the accommodation cavity 221. Preferably, a gasket 25 is disposed at the opening of the accommodation cavity 221 to further improve the sealing effect. Definitely, in other embodiments, caps in other shapes and other fixing manners may further be used to close the opening.

Preferably, a middle portion of the elastic pin 21 is projected outwards in an arced mode to form a pressing portion 211, a tail end thereof extends into an insertion cavity of the female buckle 3 and is projected on upper and lower surfaces to form a hook portion 212, and a hook position 33 adapted to the hook portion 212 is disposed in the insertion cavity. The pressing portion 211 can be exposed from a sidewall opening 34 of the insertion cavity to act as a stop, and the hook portion 212 can further be hooked with the hook position 33 to form a double-hook structure, such that the fit is tight and the connection is firm, thereby further improving the safety and reliability.

Preferably, outer surfaces of the pressing portion 211 and the guide rod 23 are each provided with a material-saving recess 4, which, on the basis of ensuring the overall structural strength, reduces the material used, the cost and the weight, and also is convenient to use.

During use, by slightly pressing the waterproof sealed cap 16, the touch switch 13 can be triggered by the elastic presser foot 15 to further switch on a light-emitting loop of the light-emitting device 1, and the LED lamps 12 emit light. The male buckle and the female buckle 3 are both made of a transparent or translucent material, light emitted by the LED lamps 12 can be quickly conducted and diffused to the whole structure, the light-emitting area is large, the light-emitting effect is good, and it can provide a striking vision warning function when being used by a user outdoor or in a dark environment, can precisely show the position of the user, effectively avoids occurrence of accidents and is safe.

The present invention discloses a light-emitting safe buckle, including a light-emitting device, and a male buckle and a female buckle made of a transparent or translucent material, the light-emitting device being disposed on an intermediate setting portion of the male buckle. The present invention makes full use of the space ingeniously to dispose the light-emitting device on the male buckle, thus having a beautiful appearance without any abrupt feeling. Moreover, the male buckle and the female buckle are both made of a transparent or translucent material, light emitted by the light-emitting device can be quickly conducted and diffused to the whole structure, the light-emitting area is large, the light-emitting effect is good, and it can provide a striking vision warning function when being used by a user outdoor or in a dark environment, can precisely show the position of the user, effectively avoids occurrence of accidents and is safe. Moreover, the LED lamps may be in many colors, thus having more warning effects. In addition, the present invention is impact in overall structure, tight in connection, high in reliability, small in volume, and easy to implement, thereby being conducive to wide popularization, and being applicable to articles such as clothes, packing belts, hiking backpacks, and pet chain ropes.

According to the disclosure and teachings of the specification, those skilled in the art can further vary and modify the above implementations. Therefore, the present invention is not limited to the specific implementations disclosed and described above, and some modifications and variations to the present invention shall also fall within the protection scope of the claims of the present invention. Moreover, some specific terms are used in this specification; however, these terms are merely used for convenient illustration, instead of limiting the present invention. Other buckles identical or similar to that in the present invention all fall within the protection scope of the present invention.

What is claimed is:

1. A light-emitting safe buckle, comprising:

a light-emitting device;

a male buckle and a female buckle made of a transparent or translucent material;

an intermediate setting portion being disposed between two elastic pins of the male buckle, one end position of the intermediate setting portion facing the female buckle being projected to form a guide rod, a guide slot adapted to the guide rod being disposed on the female buckle, the intermediate setting portion being provided with an accommodation cavity for disposing the light-emitting device, and the light-emitting device being disposed in the accommodation cavity; and where the female buckle includes a notch having the guide slot, where a contour of the notch corresponds to a contour of the intermediate setting portion, and when the buckle is in a buckled position the intermediate setting portion is guided into the notch, including the guide rod positioned within the guide slot.

2. The light-emitting safe buckle according to claim 1, wherein the contour of the intermediate setting portion is triangle-shaped, the contour of the notch is triangular shaped, and the guide rod is located at a corner portion position of the intermediate setting portion facing the female buckle.

3. A light-emitting safe buckle, comprising:

a light-emitting device;

a male buckle and a female buckle made of a transparent or translucent material;

an intermediate setting portion being disposed between two elastic pins of the male buckle, one end position of the intermediate setting portion facing the female buckle being projected to form a guide rod, a guide slot adapted to the guide rod being disposed on the female buckle, the intermediate setting portion being provided with an accommodation cavity for disposing the light-emitting device, and the light-emitting device being disposed in the accommodation cavity;

wherein the contour of the intermediate setting portion is triangle-shaped, and the guide rod is located at a corner portion position of the intermediate setting portion facing the female buckle; and wherein the light-emitting device comprises a control circuit board, LED lamps, a touch switch and a battery, the touch switch being disposed in a center position of the control circuit board, the plurality of LED lamps being symmetrically disposed at peripheral positions of the control circuit board with the touch switch as the center of a circle and facing an inner wall of the accommodation cavity, and the battery being disposed at a lower position of the control circuit board and being connected to the control circuit board.

4. The light-emitting safe buckle according to claim 3, wherein there are three LED lamps which are disposed at the peripheral positions of the control circuit board symmetrically about the center of a circle, and correspondingly face three corner portions of the intermediate setting portion.

5. The light-emitting safe buckle according to claim 3, wherein a position on an upper surface of the male buckle corresponding to the accommodation cavity is provided with an elastic presser foot that can trigger the touch switch when being pressed downwards, and a waterproof sealed cap for covering the elastic presser foot is disposed on the male buckle.

6. The light-emitting safe buckle according to claim 3, wherein an opening of the accommodation cavity is located on a lower surface of the male buckle, a round screw-cap capable of closing the opening is disposed on the male buckle, a lower surface of the round screw-cap is provided with a rib convenient for turning the round screw-cap, an outer side surface of the round screw-cap is provided with a rotation position groove, and the inner wall of the accommodation cavity is provided with a rotation position repousse adapted to the rotation position groove.

7. The light-emitting safe buckle according to claim 3, wherein an opening of the accommodation cavity is located at a lower surface of the male buckle, and a triangular cap capable of closing the opening is fixed on the male buckle with a screw.

8. The light-emitting safe buckle according to claim 1, wherein a middle portion of the elastic pin is projected outwards in an arced mode to form a pressing portion, a tail end thereof extends into an insertion cavity of the female buckle and is projected on upper and lower surfaces to form a hook portion, and a hook position adapted to the hook portion is disposed in the insertion cavity.

9. The light-emitting safe buckle according to claim 8, wherein an outer surface of the pressing portion is provided with a material-saving recess, and an outer surface of the guide rod is provided with a material-saving recess.

10. A buckle comprising:

a light-emitting device;

a buckle assembly including a first buckle and a second buckle;

an intermediate portion located in the buckle assembly, the intermediate portion including a cavity, the light-emitting device being positioned in the cavity, and where when the light-emitting device is activated, the buckle assembly emits light; and wherein the light emitting device including a control circuit board, lamps, a touch switch and a battery, the touch switch being disposed in a center position of the control circuit board, the lamps being symmetrically disposed at peripheral positions of the control circuit board with the touch switch as the center of a circle and facing an inner wall of the cavity, and the battery being disposed at a lower position of the control circuit board and being connected to the control circuit board.

11. The buckle of claim 10, where the first buckle is a male buckle, and the second buckle is a female buckle.

12. The buckle of claim 10, where the first buckle and the second buckle are made of a transparent or translucent material.

13. The buckle of claim 10, where the first buckle includes two pins, and where the intermediate portion is located between the two pins.

14. The buckle of claim 10, the light emitting device including at least 3 lamps.

15. The buckle of claim 10, wherein when the light-emitting device is activated, the first buckle emits light and the second buckle emits light.

16. The buckle of claim 1, where the guide rod includes a guide stop extending from a surface of the guide rod, that aids in positioning the guide rod in the guide slot.

17. The buckle of claim 16, where a shape of the guide stop corresponds to a shape of the surface opening of the guide slot.

18. The buckle of claim 1, where the contour of the guide rod is different than the contour of the notch.

* * * * *